US005921545A

United States Patent [19]

Kobayashi et al.

[11] Patent Number: 5,921,545

[45] Date of Patent: Jul. 13, 1999

[54] AUTOMATIC SHEET FEEDING APPARATUS

[75] Inventors: Misao Kobayashi, Kofu; Norihiro Ohno, Yamanashi-ken, both of Japan

[73] Assignee: Nisca Corporation, Yamanashi-ken, Japan

[21] Appl. No.: 09/039,726

[22] Filed: Mar. 16, 1998

Related U.S. Application Data

[51] Int. Cl.[6] ..... B65H 9/04

[52] U.S. Cl. ..... 271/242; 271/245; 271/274; 400/631

[58] Field of Search ..... 400/631, 630; 271/4.08, 4.1, 186, 65, 301, 291, 242, 245, 273, 274

[56] References Cited

U.S. PATENT DOCUMENTS

| | | | |
|---|---|---|---|
| 5,253,861 | 10/1993 | Schmaling | 271/273 |
| 5,566,933 | 10/1996 | Salancy | 271/273 |
| 5,673,911 | 10/1997 | Loftus et al. | 271/273 |
| 5,772,202 | 6/1998 | Singer et al. | 271/245 X |

FOREIGN PATENT DOCUMENTS

| | | |
|---|---|---|
| 57-1780 | 1/1982 | Japan . |
| 58-31837 | 2/1983 | Japan . |
| 60-657 | 1/1985 | Japan . |
| 7199556 | 8/1994 | Japan . |

*Primary Examiner*—Edgar Burr
*Assistant Examiner*—Minh H. Chau
*Attorney, Agent, or Firm*—Kane,Dalsimer,Sullivan, Kurucz, Levy, Eisele and Richard, LLP

[57] ABSTRACT

An apparatus for automatically feeding sheets to an image forming device such as a copying machine is provided with a sheet register means formed of one or more outside rollers movable into and out of contact with one or more feed rollers in rotation and one or more inside rollers located side by side with the feed rollers, so that the outside rollers rotate when being in touch with the feed rollers to forward the sheet. The outside and inside rollers are rockingly moved by shifting means, so that, when the sheet is given from a sheet supply unit, the outside rollers is separated from the feed rollers to rest the outside and inside rollers so as to bring the sheet into collision with the resting outside and inside rollers to slightly bend the leading portion of the sheet, consequently fulfilling a registering function of correcting the orientation of the sheet with relation to a feeding direction. Thereafter, the sheet is forwarded through the register means by bringing the outside rollers in contact with the rotating feed rollers. The sheet feeding operation is performed can be carried out with high efficiency, since the sheet registering function can be performed without stopping rotation of the feed rollers.

23 Claims, 10 Drawing Sheets

AUTOMATIC SHEET FEEDING APPARATUS

BACKGROUND OF THE INVENTION

1. Field of the Invention

This invention relates to an apparatus for automatically feeding sheets to an image forming device such as a copying machine, and more particularly to an automatic sheet feeding apparatus equipped rationally with a register means for properly correcting the orientation of a feeding sheet with relation to a feeding direction.

2. Description of the Prior Art

There has been used an automatic sheet feeding apparatus such as a document feeder in an image forming device such as a copying machine, facsimile and image scanner, in which one or more original documents stacked on a document supply tray are automatically fed one by one to an image reading portion of the image forming device, and the original document after subjected to image reading at the image reading portion is automatically sent out to a discharge tray. The document feeding device is generally provided on the route from the document supply tray to the image reading portion with a register means for properly correcting the orientation of the document being forwarded with relation to a feeding direction. With the register means, even if the original document is forwarded at a slant relative to the document feeding direction (longitudinal direction of a document feeding passage), the document advancing obliquely (with its leading edge thereof being not orthogonal to the document feeding direction) is corrected in its posture to the proper feeding direction (as a result, the leading edge of the document becomes orthogonal to the document feeding direction).

The register means as noted above has functions of not only making the posture of the document to be fed proper, but also determining timing of reading the image on the document at the image reading portion.

Describing now in detail the document registering function of the register means for properly feeding the original document with reference to FIG. 1A and FIG. 1B, there is shown the register means R of the automatic document feeding device applied to the image forming device such as a copying machine and facsimile, which usually comprises a pair of rollers r1 and r2 which come in contact with each other on a document feeding passage W. The rollers r1 and r2 rotate in opposite directions so as to forward the document along the document feeding passage W in the feeding direction (arrow a).

Until the document advancing along the feeding passage arrives at a contact line (nip point Np) of the rollers r1 and r2, the rollers r1 and r2 are not yet rotated. Then, the rollers r1 and r2 are started to rotate immediately after the document collides with the rollers at the nip point.

That is, in the case where the document D advancing along the feeding passage W is slanting with relation to the feeding direction unlike a properly oriented document Da as illustrated in FIG. 1A, the document D is forwarded until colliding with the nip point Np of the rollers and moved some more forwardly after it collides with the nip point Np, with the consequence that the document D is slightly bent at its leading portion as shown in FIG. 1B.

Consequently, the leading edge of the slanting document D thus bent slightly comes into linear contact with the nip point Np and is aligned orthogonally to the forwarding direction. Thereafter, the rollers r1 and r2 are started to rotate to forward the document, so that the document passing through the rollers assumes its posture oriented to the proper feeding direction as indicated by the imaginary line Dx in FIG. 1B. Thus, correction of the orientation of the document being forwarded toward the image reading portion is accomplished.

In the illustrated register means R, one of the rollers r1 and r2 may be driven, and the other roller may come in frictional contact with the driving roller.

A conventional automatic document feeding device incorporating the register means of this type is schematically shown in FIG. 2A as one example, which is applicable to a digital copying machine or a facsimile. In general, such a document feeding device as illustrated is placed on the image forming device M such as a copying machine and comprises a document supply tray 1 for stacking one or more original documents to be subjected to image reading, a document delivery means including a kick roller 3*a* for sending out the documents one by one from the document supply tray 1 into a feeding passage W, a large-diameter feed roller 5 for forwarding the document from the document supply tray toward an image reading point Px, and a register roller 7 coming in press contact with the feed roller 5. While the document passes through the image reading point Px defined beneath the feed roller 5, the image on the document is read with an image reading element IR such as an image sensor mounted in the image forming device M.

The register roller 7 in this document feeding device corresponds to the roller r1 in the device shown in FIG. 1, and the large-diameter feed roller 5 corresponds to the roller r2 in FIG. 1. So, the rollers 5 and 7 constitute a register means R.

Accordingly, until the document D sent from the document supply tray 1 into the feeding passage W comes into collision with the nip point Np of the feed roller 5 and the register roller 7, the rollers 5 and 7 are kept from rotating. Thereafter, when the document D collides with the nip point Np, and then, is slightly bent as shown in FIG. 2A, the rollers 5 and 7 resting at this point are started to rotate. That is, even if the document is sent from the document supplying tray 1 at the slant with relation to the document feeding direction, the leading edge of the slanting document is aligned with the nip point Np of the rollers 5 and 7, which is orthogonal to the document feeding direction. The rollers 5 and 7 are started to rotate in such a state that the leading edge of the document comes in straight contact with the contact line between the rollers, consequently to cause the document to be oriented straight to the proper forwarding direction and properly forwarded along the feeding passage W. In a case where a plurality of documents are handled, the large-diameter feed roller must be repeatedly stopped and started to rotate.

Conventional sheet feeding apparatuses similar or equivalent in mechanism to the aforesaid structure are disclosed in Japanese Patent Application Public Disclosures Nos. SHO 52-53430(A) (corresp. to U.S. application. Ser. No. 624,860 filed Oct. 23, 1975), SHO 57-1780(A), SHO 58-31837(A), and HEI 7-199556(A).

These sheet feeding apparatuses have a tendency to increasing the inertial mass of the feed roller 5 so as to move the document or sheet stably and smoothly. Furthermore, in order to secure a circulating passage around the feed roller 5, through which the document passes to be automatically turned over for the purpose of reading images on both sides of the document, the circumference of the feed roller 5 should be made longer than the length of the document to be handled. Thus, the feed roller 5 should be made large in diameter, with the consequence that the large-diameter feed roller, which must be repeatedly stopped and started to rotate for correcting the orientation of the document being forwarded, necessitates large starting torque when being started to rotate.

Accordingly, each time the original document fed to the aforementioned document feeding device is connected in its orientation, the large-diameter feed roller 5 is highly wasteful energy for repeatedly starting and stopping. Besides, the feed roller having relatively large mass inevitably entails a disadvantage such that it becomes dull in starting the rotation, thereby to cause delay of movement, and impedes smooth and continuous operation for feeding the document, and that the automatic sheet feeding apparatus incorporating the large-mass feed roller cannot be operated at high speed.

OBJECT OF THE INVENTION

An object of the present invention is to provide a sheet feeding apparatus capable of automatically feeding continuously and smoothly sheets such as original documents to an image forming device such as a copying machine with high efficiency.

Another object of this invention is to provide a sheet feeding apparatus provided with a register means capable of being effectively operated without degrading the operational performance of the apparatus, which functions to correct the orientation of a feeding sheet with relation to a proper feeding direction.

Still another object of this invention is to provide a sheet feeding apparatus having a register means assembled rationally in a sheet feeding system, which serves to correct the orientation of a feeding sheet with relation to a proper feeding direction and is driven by making good use of a driving force for the sheet feeding system, thereby to effectively perform a function for registering the feeding sheet.

Yet another object of this invention is to provide a sheet feeding apparatus capable of rationally assembling, in a sheet feeding system having a high-performance register means, supplementary functional elements such as marking means for automatically applying a specific marking stamp onto a document upon completion of image reading.

A further object of this invention is to provide a sheet feeding apparatus having a register means for effectively correcting the orientation of a feeding sheet with relation to a proper feeding direction, which is applicable to various types of image forming devices such as a copying machine, facsimile and image scanner so as to automatically feed a plurality of sheets or documents to the respective image forming devices with high efficiency.

SUMMARY OF THE INVENTION

To attain the objects described above according to this invention, there is provided an automatic sheet feeding apparatus comprising a sheet supply unit for storing one or more sheets, a sheet delivery means for sending out the sheets one by one from the sheet supply unit, a register means including a sheet feed roller set having a sheet feeding passage formed therearound, one or more outside rollers movable into and out of contact with at least one of the feed rollers, and one or more inside rollers movable into and out of contact with at least one of the outside rollers, and shifting means for rockingly moving one of the outside rollers or inside rollers to bring the outside rollers into and out of the feed rollers.

The automatic sheet feeding apparatus of the invention is mounted so as to overlay an image reading portion defined on an image forming device such as a copying machine, so that the sheet given from the sheet supply unit is fed to the image reading portion through the sheet feeding passage.

While one or more sheets such as original documents are continuously fed, the feed rollers constantly rotate in a sheet feeding direction. The outside rollers in frictional contact with the feed rollers are driven by the feed rollers.

The outside rollers are placed side by side with the feed rollers. The opposed outside and inside rollers come in press contact with each other, so that the contact line defined between the outside and inside rollers being in contact therewith is orthogonal to the sheet feeding direction.

When the sheet is sent from the sheet supply unit into the sheet feeding passage formed along a part of the outer periphery of the feed rollers, the outside and inside rollers are in contact with each other so that the outside rollers are remained separate from the feed rollers, consequently to stop the outside and inside rollers. That is, the outside and inside rollers are not yet rotated independently of the feed rollers being rotated to forward the sheet, and they are still at a stop when the sheet arrives at the register means, thus preventing the sheet from passing through the register means.

By further moving forwardly the sheet colliding with the register means, the leading part of the sheet is bent, so that the leading edge of the sheet is aligned with the contact line which is defined between the outside and inside rollers and extends orthogonal to the sheet feeding direction. When the leading edge of the sheet collides with the contact line defined between the outside and inside rollers and is slightly bent, the outside or inside rollers are rockingly moved by the shifting means so as to bring the outside rollers in contact with the feed rollers. As a result, the outside rollers are rotated by the feed rollers, thus allowing the sheet which has been stopped by the standing outside and inside rollers to move toward the image reading portion of the image forming device through the register means.

Even if the sheet is sent out from the sheet supply unit at a slant with relation to the sheet feeding direction, it is properly corrected to be oriented to the sheet feeding direction. Moreover, the register means provides proper timing of starting image reading in the image forming device.

A sheet supply point is defined at an intersection point between a sheet supplying passage from the sheet supply unit and the sheet feeding passage formed around the feed rollers, so that the image reading portion of the image forming device is opposed to the sheet supply point astride the feed rollers.

On the route of a passage opposite to the sheet feeding passage extending from the sheet supply point to the image reading portion in the sheet forwarding direction, there is positioned a diverging exit point at which a sheet discharge unit is provided. The sheet discharge unit may incorporate marking means such as a marking stamper for automatically applying a marking stamp onto the finished sheet sent out via the sheet discharge unit. With this marking means, the finished sheet can easily be discerned from a sheet still to be subjected to image reading.

Other objects and features of the present invention will be hereinafter explained in detail with reference to the accompanying drawings.

DESCRIPTION OF THE PREFERRED EMBODIMENTS

This invention relates to a sheet feeding apparatus for automatically and continuously, in particular, one or more original documents one by one to an image reading portion of an image forming device such as a copying machine and facsimile, incorporating a register means including a sheet feed roller set which continuously rotates even during correcting the orientation of the feeding original document with relation to a proper feeding direction. That is, according to the invention, the correcting of the orientation of the feeding original document can be carried out without stopping the rotation of the sheet feed roller set.

Figure 3:
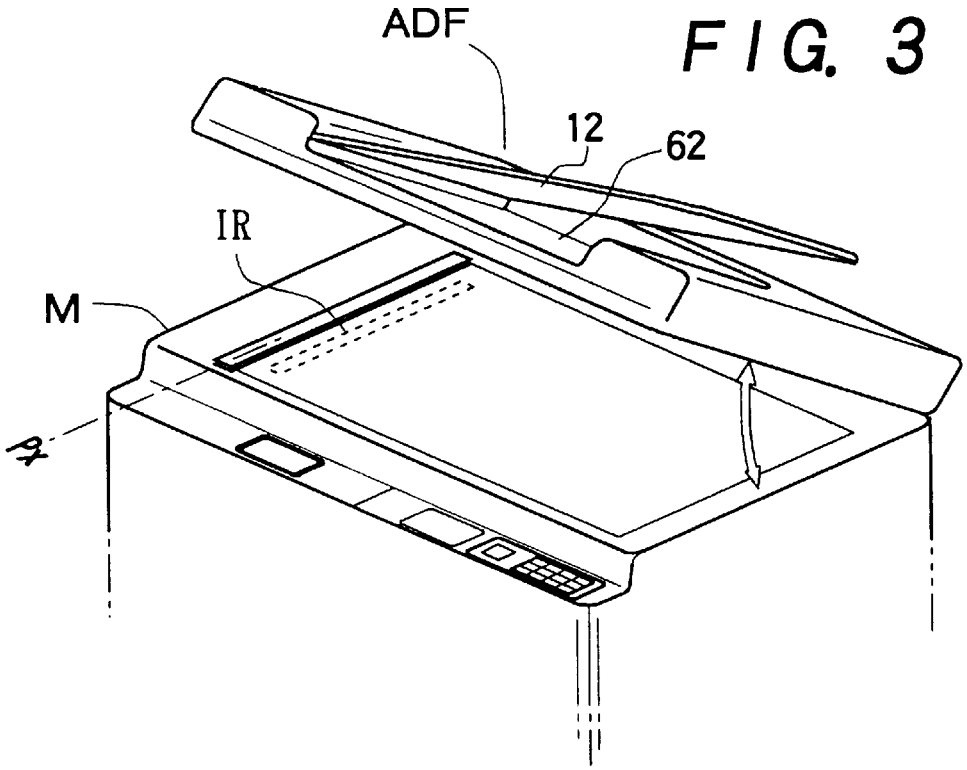
FIG. 3 is a perspective view schematically showing one example of an image forming device to which this invention is applied.

FIG. 3 shows the automatic sheet feeding apparatus (automatic document feeder) ADF according to this invention mounted on the copying machine M.

As illustrated, the feeding apparatus ADF openably overlies the upper surface of the copying machine M, so that a given document is optically read by an image reading element IR arranged at an image reading point Px defined by a transparent platen on a part of the upper surface of the copying machine M while passing through the image reading point Px.

Although the sheet feeding apparatus in the illustrated embodiment is applied to a digital copying machine, this invention can be applied to not only image forming devices such as a facsimile and image scanner and any other sheet handling devices, but also a variety of printers using cut sheets, and various printing machines. Moreover, a sheet to he handled in the sheet feeding apparatus of the invention is by no means limited to an original document having images to be optically read, and may of course be of any kind and material.

Figure 4:
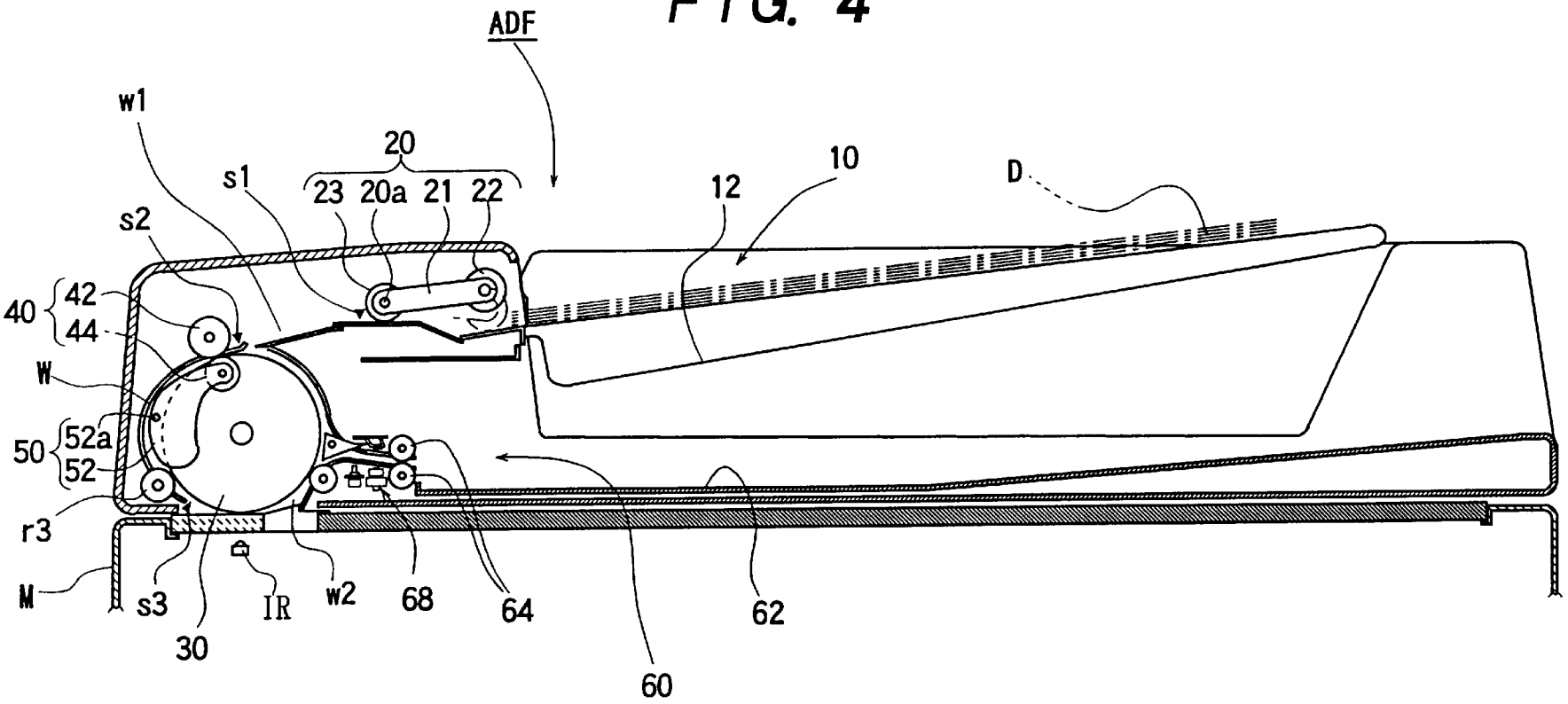
FIG. 4 is a front section schematically showing one embodiment of a sheet feeding apparatus according to this invention.

The sheet feeding apparatus ADF in this embodiment comprises a sheet supply unit 10 for supplying documents D, a sheet delivery means 20 for sending out the documents one by one from the sheet supply unit 10, a feed roller set 30 having a feeding passage W defined along at least a part of the outer periphery of the feed roller set, a register means 40 including an outside roller set 42 and an inside roller set 44, and shifting means 50 for rockingly moving the inside roller set 44, as shown in FIG. 4. The outside roller set is movable into and out of contact with the feed roller 30, and the inside roller set is movable into and out of contact with the outside roller set 42.

The sheet supply unit 10 includes a sheet supply tray 12 for stacking one or more documents D to be subjected to image processing, which is located above the copying machine M.

The sheet delivery means 20 is placed on a sheet supplying passage w1 extending from the sheet supply unit 10 to the feeding passage W formed along a part of the outer periphery of the feed roller set 30. The sheet delivery means includes a kick roller set 22 disposed on a free end of a rocking arm 21 supported rotatably by a pivot shaft 20*a*, and a carrying roller set 23 on the pivot shaft 20*a*.

When one or more documents D are set on the sheet supply tray 12 or the system is on standby, the rocking arm 21 and kick roller set 22 are rotated upward about the pivot shaft 20*a* to assume their standby upper position as indicated by the solid line in FIG. 4. In this state, the kick roller set 22 is separated from the documents D on the tray. When one of the documents D is to be fed, the kick roller set takes its lower position to be in contact with the uppermost of the documents, as indicated by the imaginary line.

Figure 5:
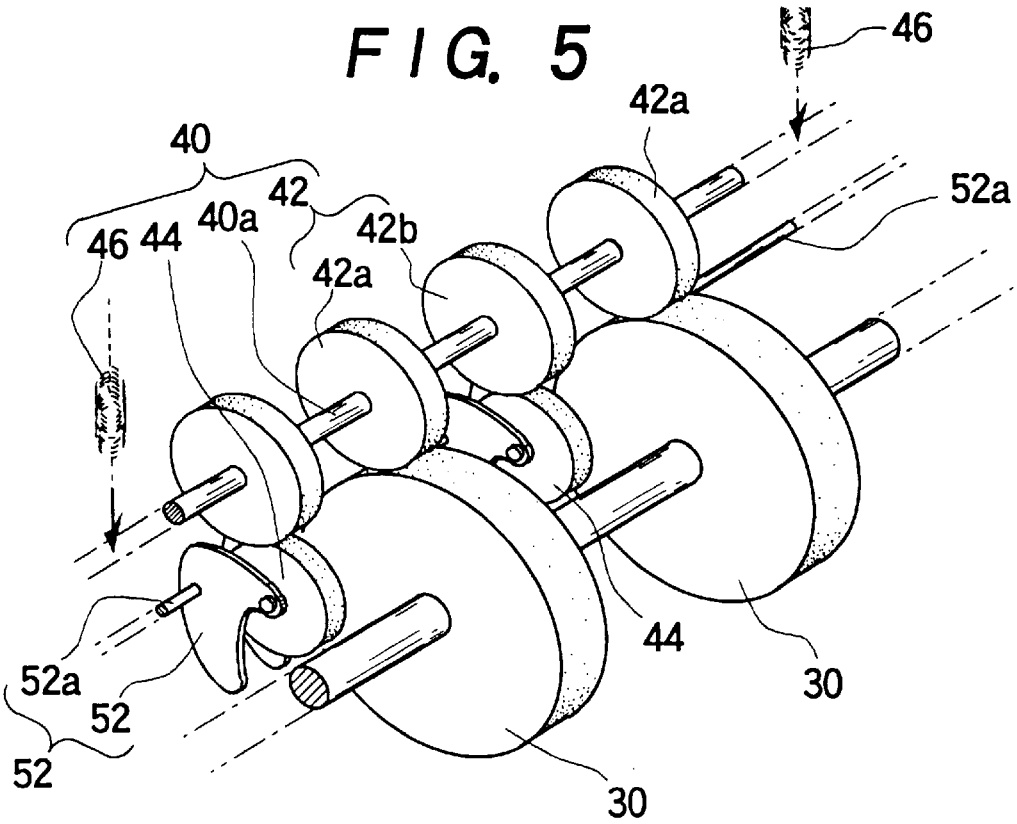
FIG. 5 is a schematic perspective view showing a register means including feed rollers in the apparatus of FIG. 4.

The feed roller set 30 in this embodiment is formed of a plurality of disk-shaped feed roller elements 30*a* arranged and spaced laterally as shown in FIG. 5.

The register means 40 is disposed on the feeding passage W near a sheet supply point Pf which is defined at an intersection point between a sheet supplying passage W formed around the feed roller set 30 and the sheet feeding passage w1, as shown in FIG. 5.

The outside roller set 42 of the register means 40 includes one or more contacting roller elements 42*a* disposed so as to come into and out of contact with the outer periphery of the feed roller set 30, and one or more operating roller elements 42*b* disposed side by side with the contacting roller elements 42*a*. These contacting and operating roller elements arc arranged laterally and supported by the rotational shaft 40*a*.

The contacting and operating roller elements 42*a* and 42*b* in this embodiment have the same diameter, but may not necessarily be made equal in diameter as far as the contacting roller elements 42*a* are permitted to come into contact with the feed roller set 30. The contacting and operating roller elements 42*a* and 42*b* may be formed in one body of a cylindrical material continuously extending laterally.

The contacting and operating roller elements 42*a* and 42*b* are not necessarily be paired. That is, the respective numbers of the contacting and operating roller elements 42*a* and 42*b* may not always be equal.

The outside roller set 42 in this embodiment is energized toward the feed roller set 30 by energizing means 46 such as a spring so as to bring the contacting roller elements 42*a* in press contact with the feed roller set 30.

The roller elements of the inside roller set 44 are located side by side with the feed roller elements 30*a* held by a driving shaft 32 and supported by the respective shifting means 50 rotatable so as to come into and out of the operating roller elements 42*b* of the outside roller set 42.

Each shifting means 50 has a push member 52 rotatable about an axis 52*a* for moving the inside roller set 44 to and fro relative to the outside operating roller elements 42*b*.

Figure 6A:
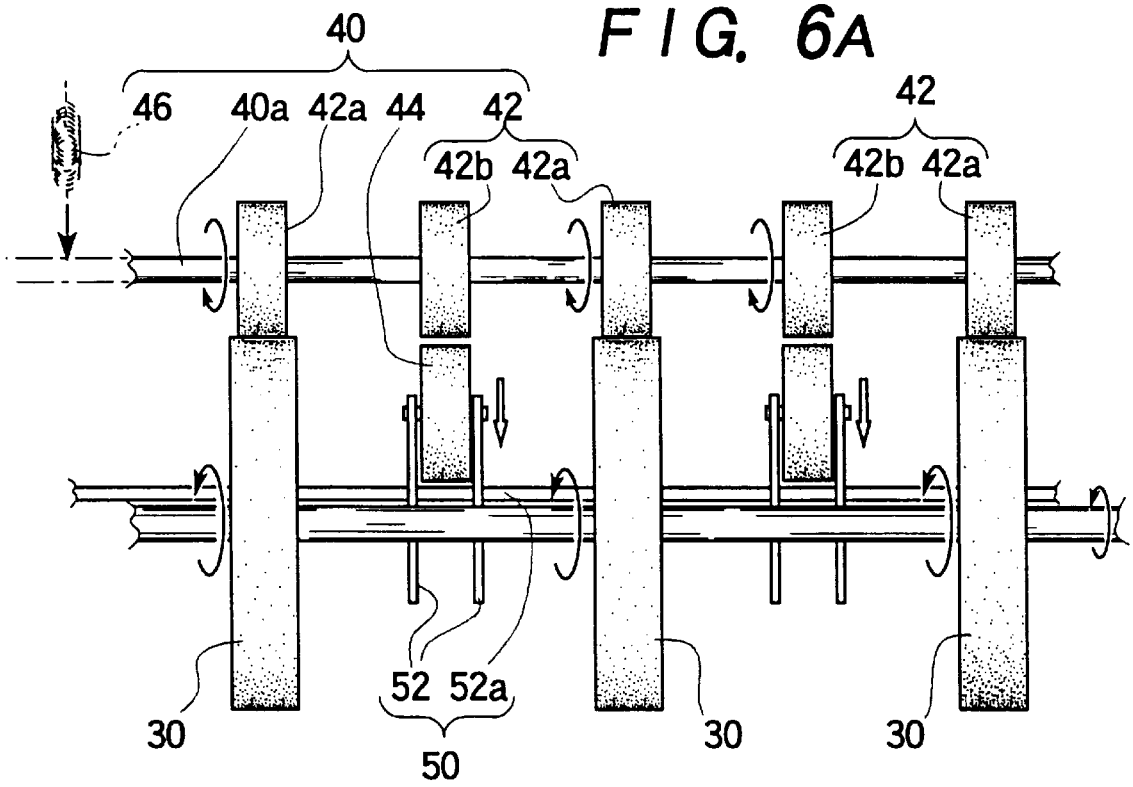
FIG. 6A and FIG. 6B are schematic side views of the structure illustrated in FIG. 5, showing the state in which the register means of the invention is operated.

Under normal conditions, the outside operating roller elements 42*b* are free from the inside roller set 44, thus allowing the outside contacting roller elements 42*a* to be in contact with the feed roller set 30 (FIG. 6A). When performing the sheet registering operation, the push member 52 rotates around the axis 52*a* to thrust the outside roller elements 42*b* through the medium of the inside roller 42.

Figure 6B:
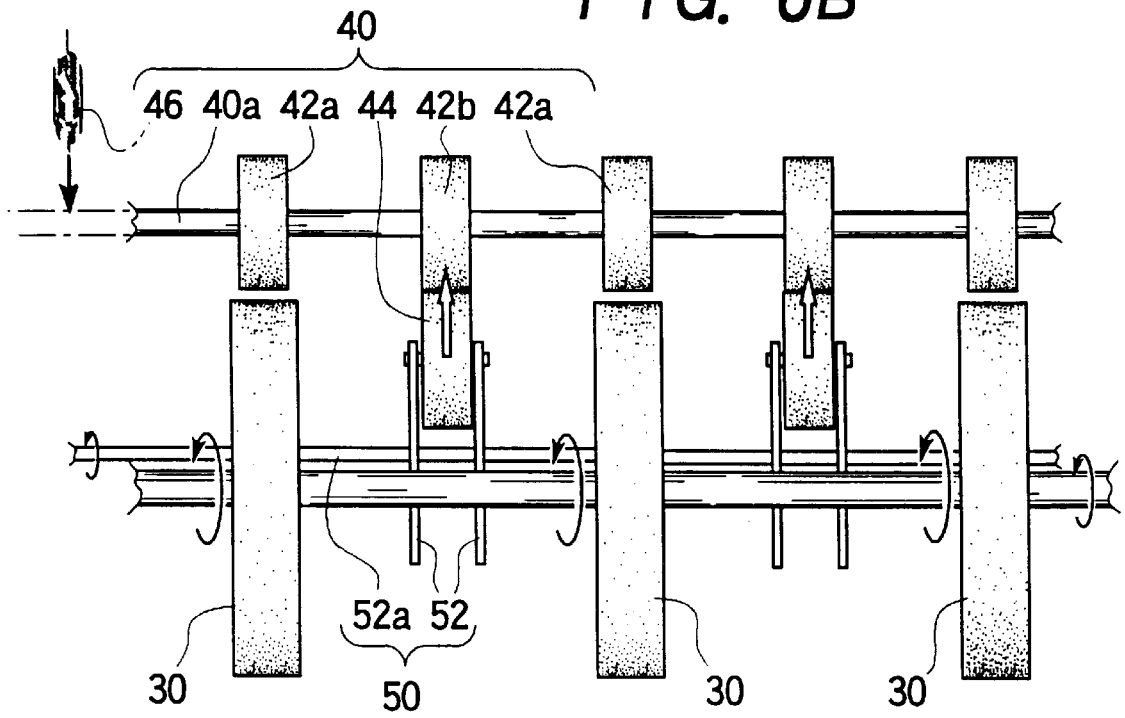

Consequently, the outside roller set 42 is separated from the feed roller set 30 against the energizing means 46 (FIG. 6B).

That is, in the sheet forwarding operation during which the outside roller set 42 is not pushed upward by the shifting means 50 as shown in FIG. 6A, the outside roller set 42 is circumscribed and the inside roller set 44 is inscribed to the outer periphery of the feed roller set 30, respectively.

When the document D is sent from the sheet supply unit 10 toward the register means 40, the inside roller set 44 is pushed upward by rotating the shifting means 50. When the document D is moved through the register means 40, deactivation of the shifting means 50 causes the inside roller set 44 to move downward. The shape of the push member 52 of the shifting means 50 is by no means limited only to the illustrated shape and the push member may have any other desired shape formed so as not to interfere with peripheral mechanisms therearound.

Broadly speaking, the feeding passage W is formed in the extent (substantially left half in FIG. 4) from the sheet supply point Pf to the image reading point Px placed below the sheet supply point, and the sheet discharge unit 60 is placed at the diverging exit point Pd defined halfway in the extent (substantially right half in FIG. 4) opposite to the feeding passage W. Between the image reading point Px and the diverging exit point Pd, a sending passage w2 is formed. Between the diverging exit point Pd and the sheet supply point Pf, a returning passage w3 is formed.

The sheet discharge unit 60 includes a discharge tray 62 located below the sheet supply tray 12, and a discharge roller set 64 mounted on the discharge passage w4 extending from the diverging exit point Pd to the discharge tray 62.

At the diverging exit point Pd, there is disposed a switch means 66 which is selectively operated for introducing the document D sent through the sending passage w2 in the feeding direction (counterclockwise direction in FIG. 4) to the discharge passage w4, or optionally sending back the document D in the discharge passage w4 to the returning passage w3.

In addition, this embodiment is provided on the discharging passage w4 with marking means 68 for applying any mark onto the document to be sent out to the discharge tray 62 upon completion of image processing.

The marking means 68 comprises an ink pad 68*a* disposed on the discharge passage w4, a stamp 68*b* opposed to the ink pad 68*a* across the discharge passage w4, pressing means 68*c* including an electromagnetic solenoid for moving the stamp 68*b* to and fro relative to the discharge passage w4.

In the drawings, reference symbols r3 and r4 denote guide rollers disposed on the feeding passage W and the sending passage w2, respectively. Reference symbols s1, s2, s3 and s4 denote a feeding sensor, register sensor, lead sensor and discharge sensor, which serve to detect the leading end or tail end of the document passing thereby in order to determine the timing of the movements of the driving components as mentioned above.

The operation of the register means 40 in the aforementioned automatic sheet feeding apparatus ADF and the processes of forwarding the document will be described with reference to FIG. 7A through FIG. 7D.

Figure 7A:
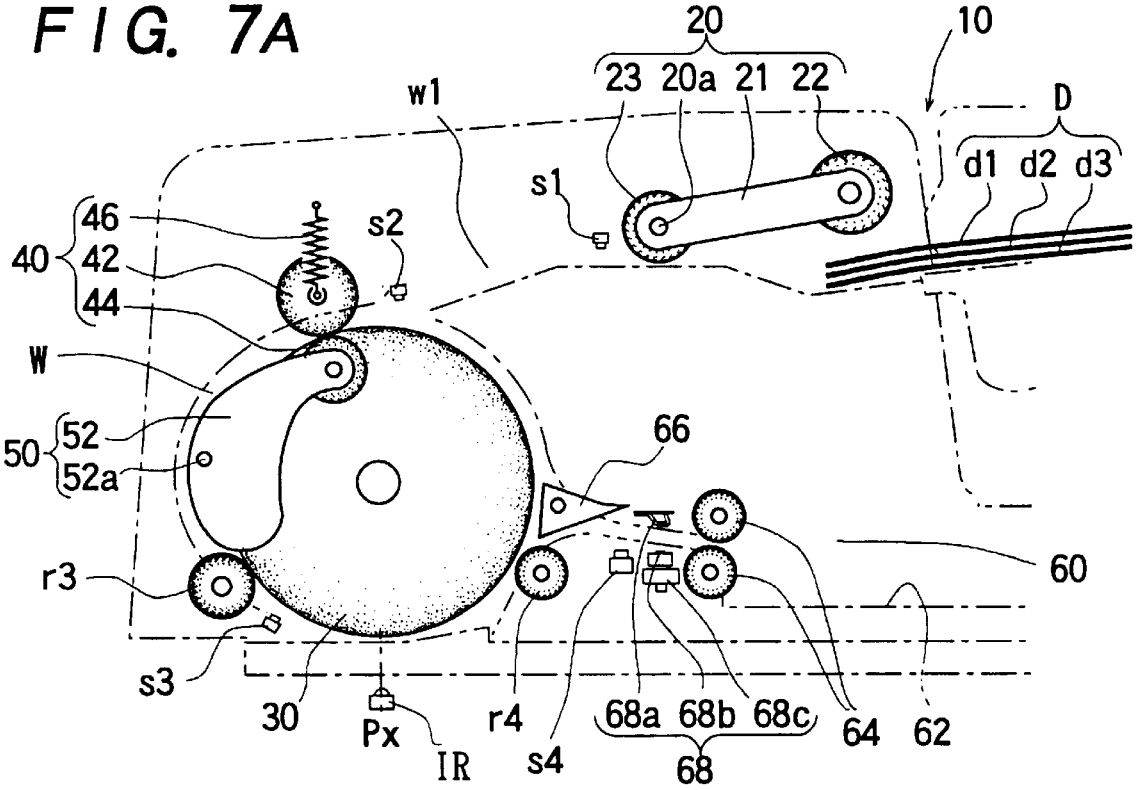
FIG. 7A through FIG. 7F are views explanatory of the operating principle of the apparatus of FIG. 4.

FIG. 7A illustrates the initial state in which one or more document d1, d2, d3 . . . to be fed are stacked on the feeding apparatus ADF. When setting the documents onto the sheet supply tray 12, the kick roller set 22 of the sheet delivery means 20 assumes its upper position so as not to obstruct the insertion of the documents into the sheet supply tray 12.

Upon completion of placing the documents on the sheet supply tray 12, a processing order is given to the copying machine M, so that the rocking arm 21 of the sheet delivery means 20 takes its lower position to bring the rotating kick roller set 22 in contact with the uppermost of the documents stacked on the sheet supply tray 12, consequently to send out the uppermost document d1 from the sheet supply tray 12 to the sheet supplying passage w1.

Figure 7B:
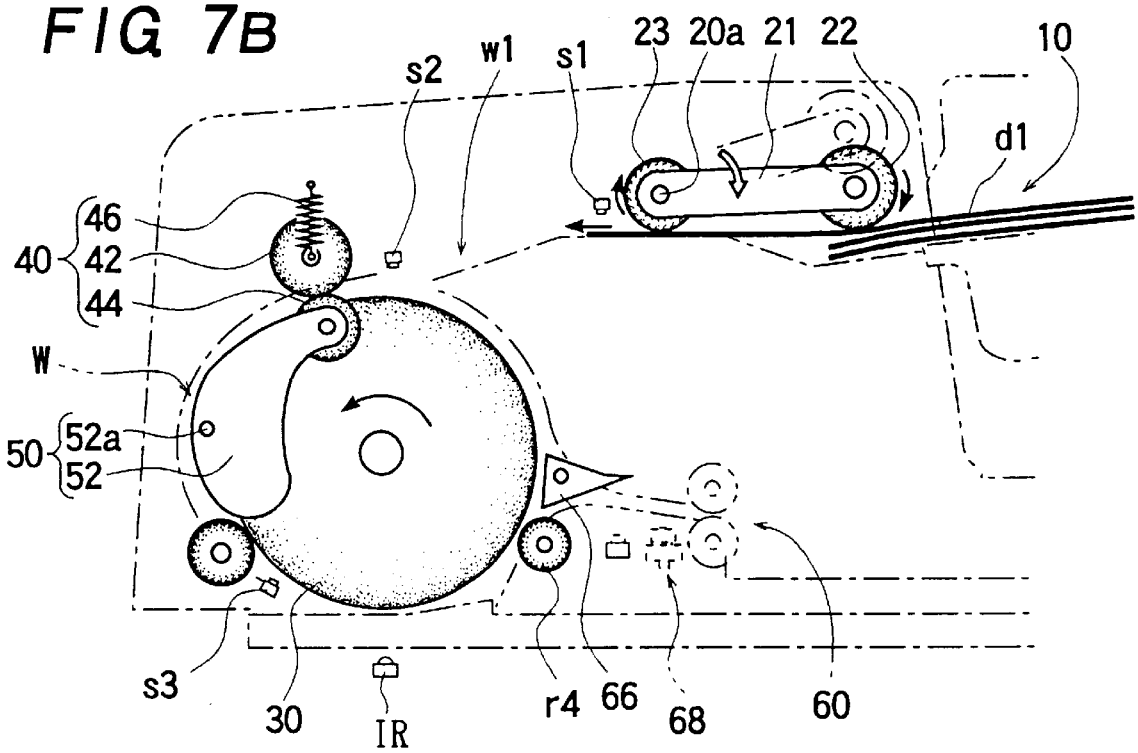

Subsequently, the document d1 given from the sheet supply tray 12 is forwarded toward the register means 40 by the rotating kick roller set 22 and carrying roller set 23. At this time, the outside roller set 42 and inside roller set 44 of the register means 40 are resting. That is, as shown in FIG. 7B and FIG. 6B, the push member 52 of the shifting means 50 is rotated upward around the axis 52*a* (in the counterclockwise direction in FIG. 7B) to push up the inside roller set 44, with the result that the outside roller elements 42*a* are separated from the feed roller set 3(), thus stopping the rotation of the outside roller set 42 and inside roller set 44 which are in contact with each other.

Figure 1A:
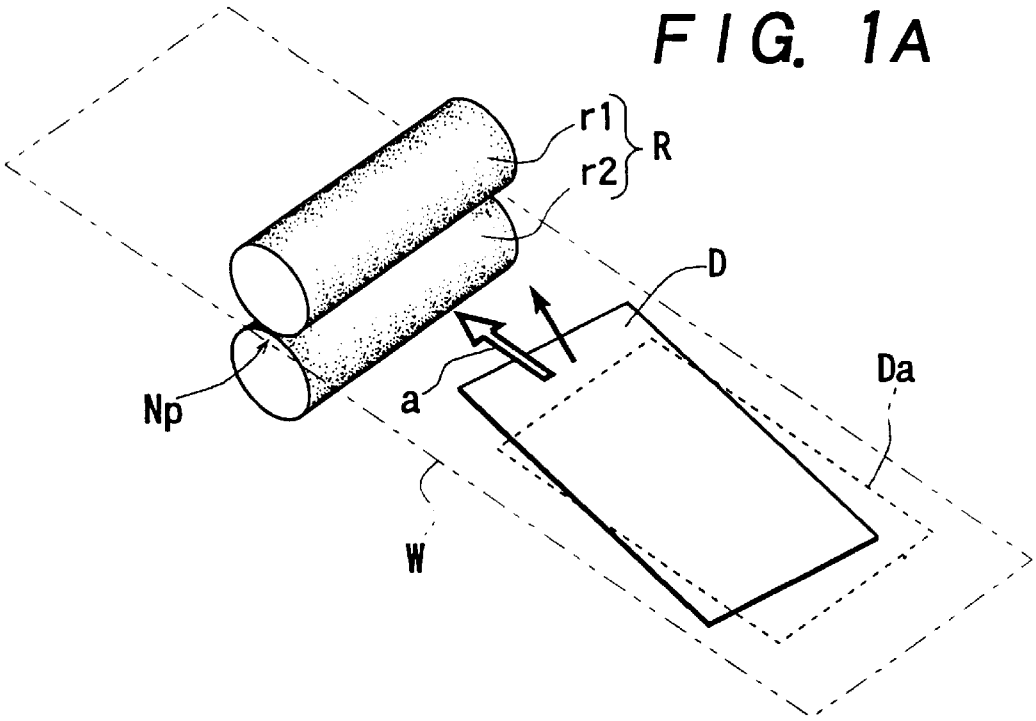
FIG. 1A and FIG. 1B are schematic perspective views explanatory of the operating principle of a register means for correcting the orientation of a document to be dealt with in a document feeding system.
Figure 1B:
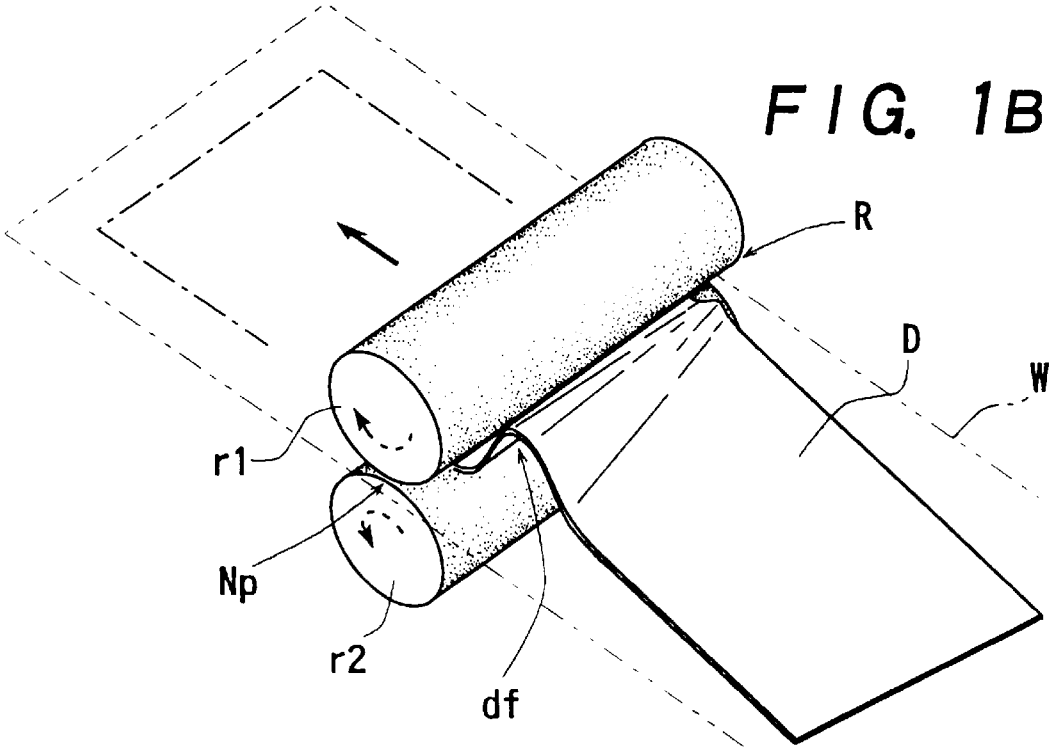
Figure 2A:
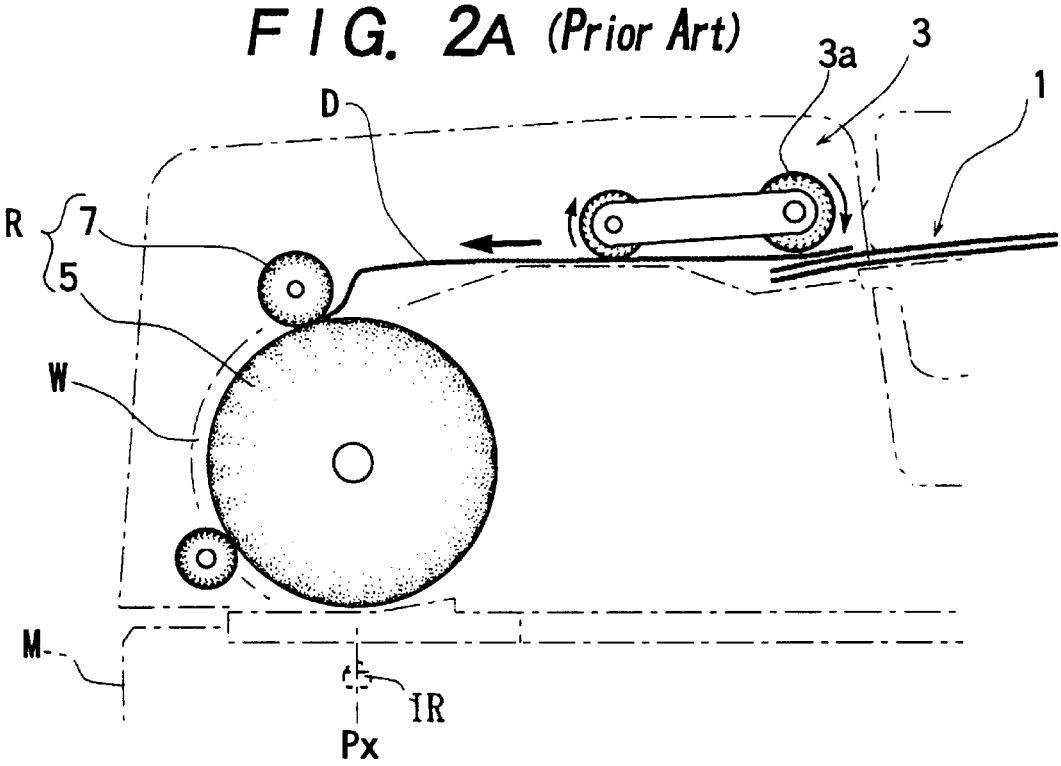
FIG. 2A (Prior Art)
FIG. 2A and FIG. 2B are schematic front views explanatory of the operating principle of a conventional register means in a prior art document feeding system.
Figure 2B:
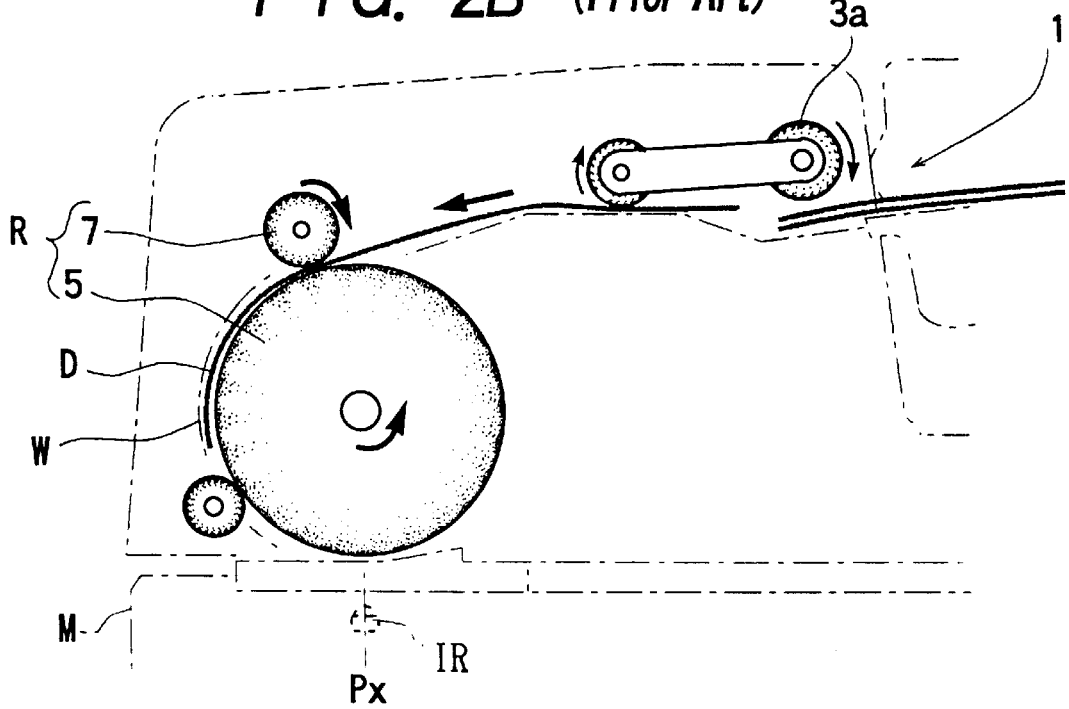
FIG. 2B (Prior Art)
Figure 7C:
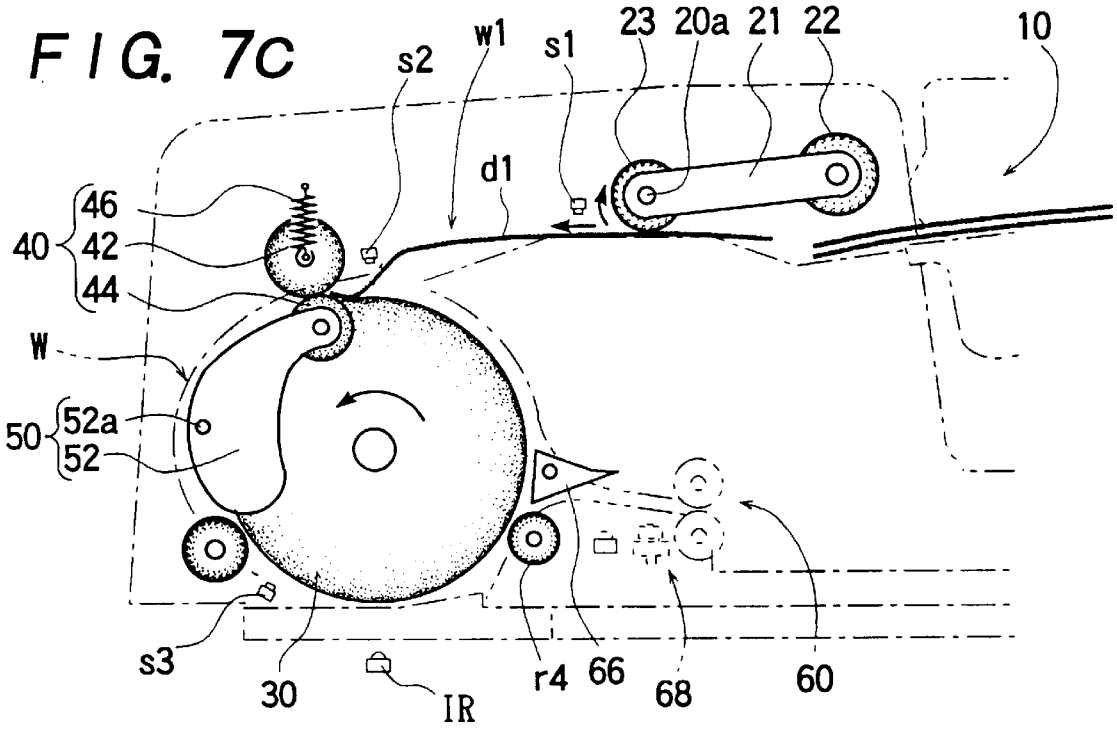

Although the document d1 sent out from the sheet supply unit 10 into the sheet supply passage w1 further advances and arrives at the roller nip point Np at which the outside roller set 42 and inside roller set 44 are contacted, the document cannot pass through the register means 40, and as a result, the leading end portion of the document is bent as shown in FIG. 7C. Consequently, the leading end (whole length in the width direction) of the document, which collides with the resting roller sets 42 and 44 to cause the document to be bent, is aligned with the nip point Np extending orthogonally to the sheet feeding direction as shown in FIG. 1B.

Figure 7D:
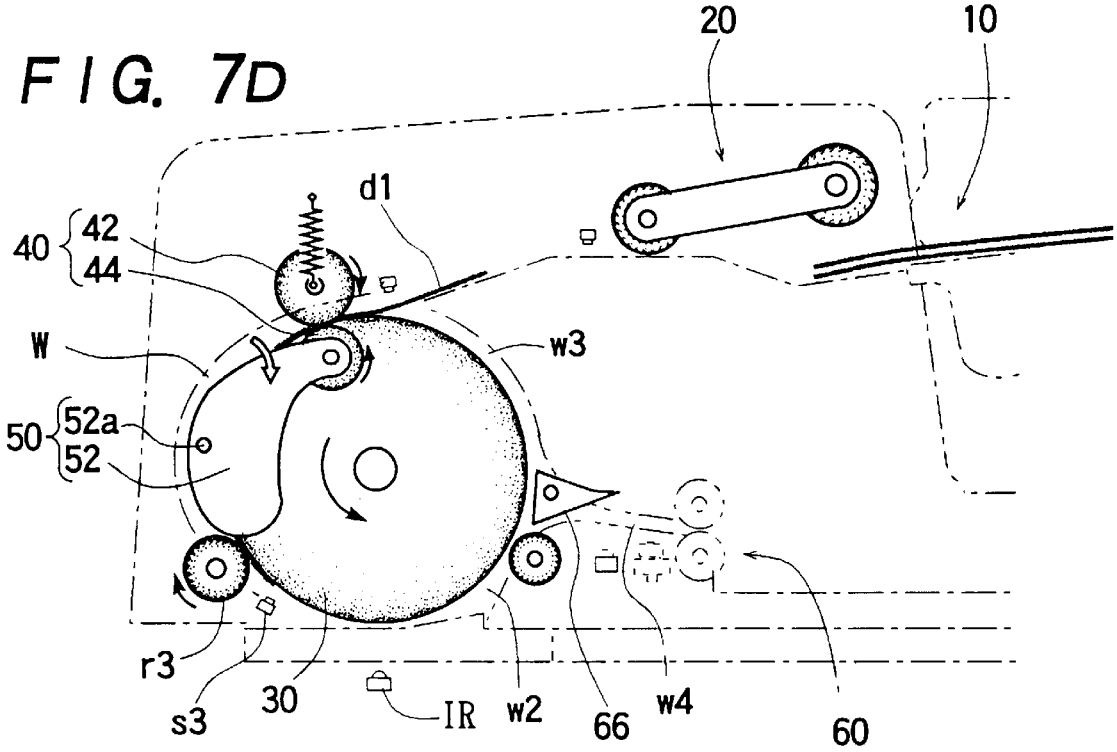

After a short lapse of time from the collision of the document d1 with the nip point Np of the outside roller set 42 and the inside roller set 44, the push member 52 of the shifting means 50 is rotated downward (in the clockwise direction in FIG. 7C), thus bringing the outside contacting roller elements 42*a* into the feed roller set 30 which rotates in the feeding direction. Consequently, the rotating feed roller set 30 imparts a rotational force to the outside roller set 42 to rotate the outside roller set in the feeding direction, and at the same time, the inside roller set 44 in contact with the outside roller set 42 rotates in the feeding direction. As a consequence, the document d1 in collision with the nip point between the outside roller set 42 and the inside roller set 44 is allowed to pass therethrough and advance along the feeding passage W in the feeding direction, and then, forwarded toward the image reading point Px through the register means 40 (FIG. 7D).

The document d1 advancing around the feed roller set 30 is subjected to image reading by the image reading element IR when passing through the image reading point Px.

The document d1 passed through the image reading point Px is sent into the sending passage w2 formed along the outer periphery of the feed roller set 30. At this time, the switch means 66 in the sheet discharge unit 60 is rotated as indicated by an arrow in FIG. 7E (in the counterclockwise direction) to connect the sending passage w2 with the discharging passage w4. Thus, the document d1 advancing through the sending passage w2 is introduced into the discharging passage w4.

In a case where the document d1 after subjected to image reading is sent out, the feed roller set 30 and discharge roller set 64 are rotated in the feeding direction to discharge the document d1 onto the discharge tray 62.

In a case where an image on the reverse side of the document d1 is further read, the discharge roller set 64 is reversed for being turned upside down, when the tail end of the document d1 advancing toward the discharge tray 62 through the discharging passage w4 is detected by the discharge sensor s4, thus to move the document along the discharging passage w4 in the reverse direction.

Figure 7E:
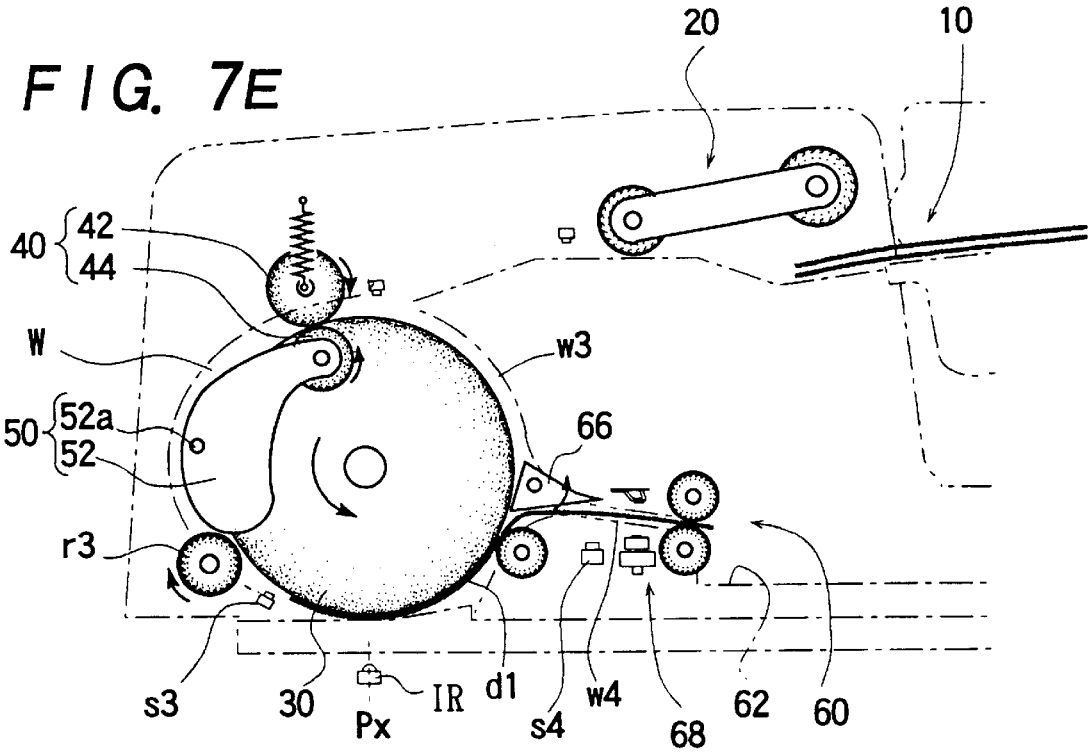
Figure 7F:
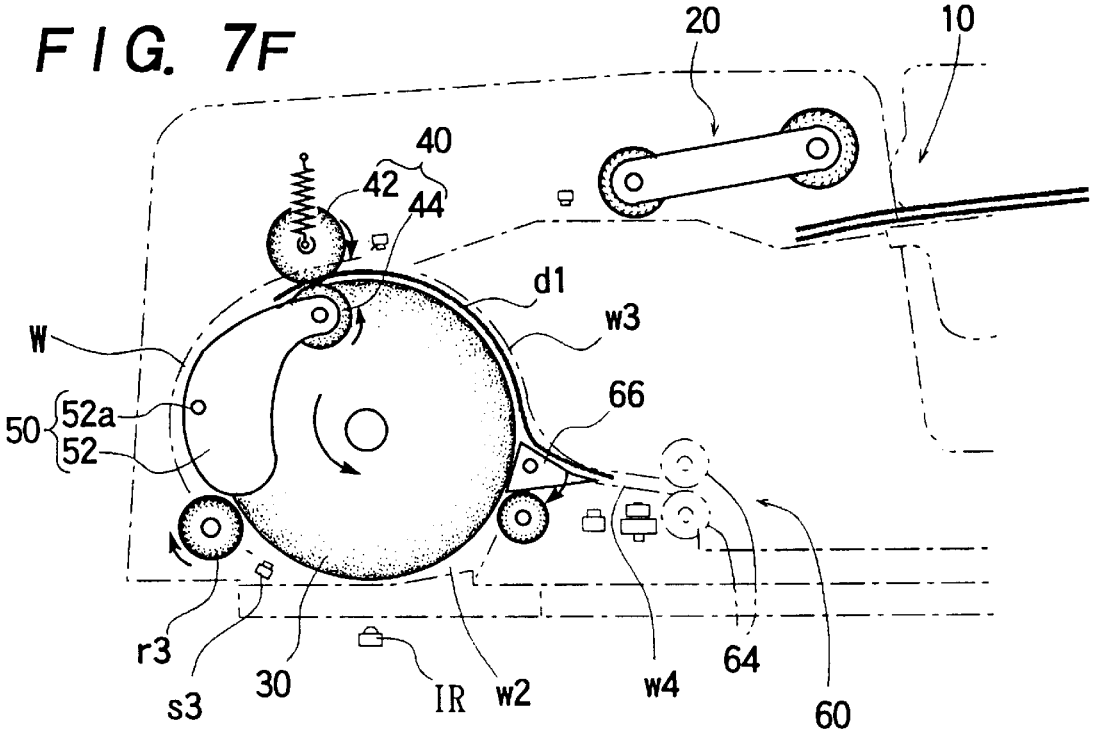

At this time, the switch means 66 is rotated downward as illustrated in FIG. 7F (in the clockwise direction) to connect the discharging passage w4 with the returning passage w3. Consequently, the document d1 is sent from the discharging passage w4 to the feeding passage W through the returning passage w3 toward the image reading point Px. The document d1, which is turned upside down in the sheet discharge unit 60 relative to the document shown in FIG. 7A, is subjected to image reading to read the image on the reverse side of the document by the image reading element IR when passing through the image reading point Px.

The document d1 thus subjected to image reading on both sides thereof is sent out to the discharge tray 62 via the sending passage w2 and discharging passage w4 in the same manner as described with reference to FIG. 7E.

In a case of continuously feeding the succeeding document d2, the aforementioned processes may be repeated fundamentally. However, by starting the succeeding document d2 when the tail end of the preceding document d1 is detected by the register sensor s2, the continuous feeding of the documents can be effectively carried out without unnecessary loss of time.

In the case where a finish mark is applied onto the finished document being discharged to the discharge tray 62 through the discharging passage w4, the pressing means 68*c* of the marking means 68 is operated to press the stamp 68*b* against the document when the tail end of the document d1 is detected by the discharge sensor s4 in the state shown in FIG. 7E.

An order for stamping the finish mark may be instituted in advance in the image forming device such as a copying machine so as to automatically apply the finish mark onto the finished document being discharged. When the stamping order is instituted, the stamp 68*b* is brought into touch with the ink pad 68*a* before the document arrives at the discharging passage w4.

A position of the document, onto which the finish mark is applied, can he freely decided by determining the timing of stamping according to the period of time required for moving the document along the discharging passage w4 on the basis of the time at which the leading end of the document is detected by the discharge sensor s4.

For speeding up of transferring the document, it is desirable to increase the speed of the movement of the entire sheet feeding system of the invention as fast as possible until the tail end of the document being discharged is detected by the discharge sensor s4, and then, decrease it when the tail end of the document is detected by the discharge sensor s4, so that the burden imposed on the stamp 68*b* reciprocating in stamping can be relieved and marking of high quality can be fulfilled.

Figure 8A:
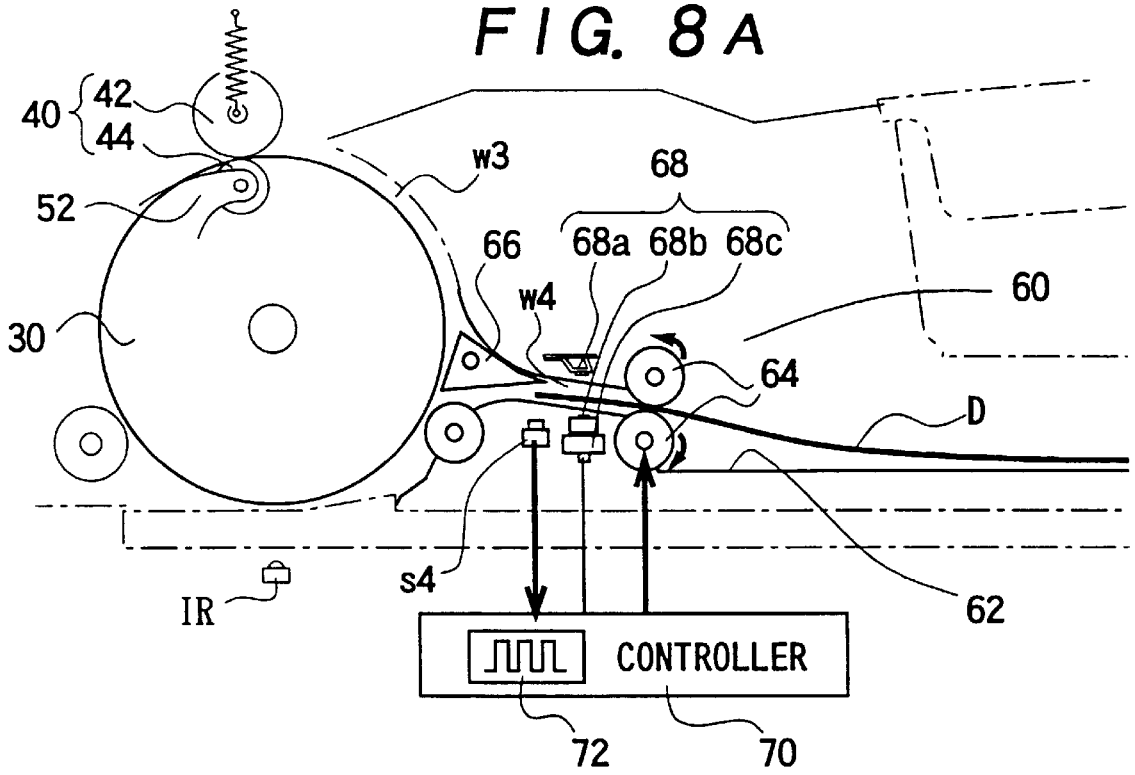
FIG. 8A and FIG. 8B are schematic diagrams explanatory of the operation of marking means in the apparatus of FIG. 4.
Figure 8B:
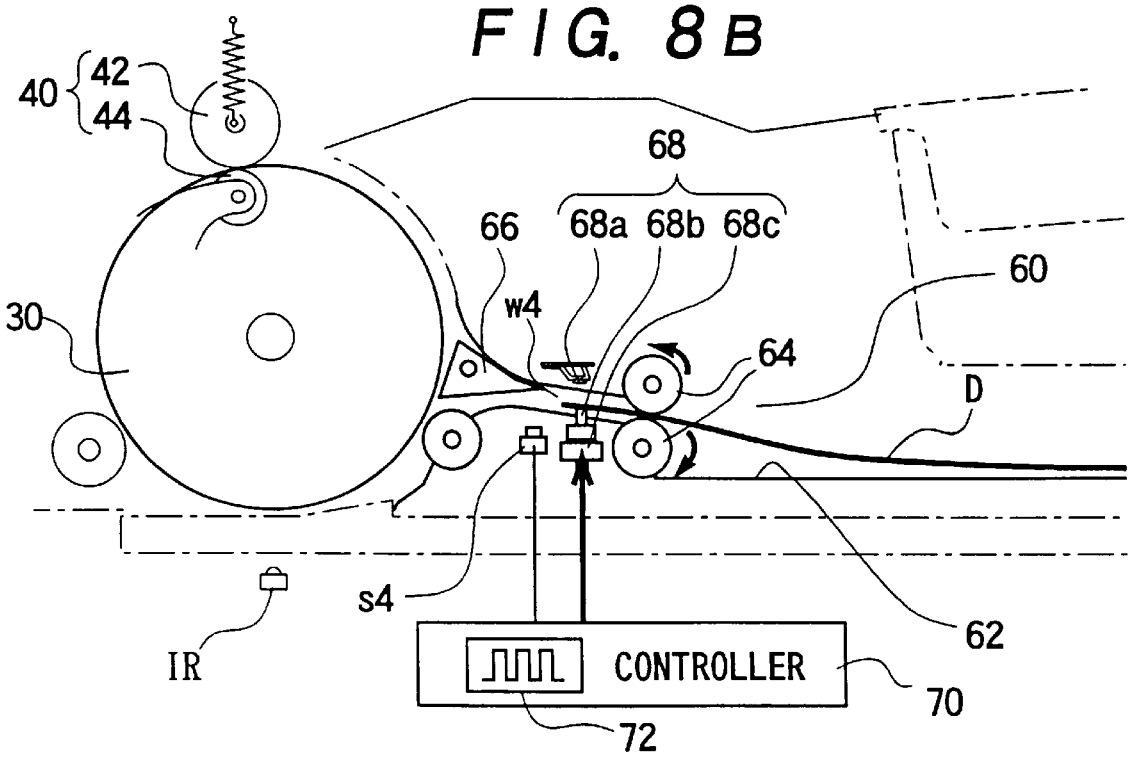

To be more specific, when the tail end of the finished document D being discharged at high speed is detected by the discharge sensor s4 and recognized by a control device 70 as shown in FIG. 8A, a slowing-down order is given to driving means (not shown) for the discharge roller set 64, and then, as shown in FIG. 8B, upon measurement of a specific time interval by use of a counter 72 incorporated in the control device 70 from the time at which the tail end of the document is detected by the discharge sensor s4, the stamping order is given to the pressing means 68*c* for operating the stamp 68*b*.

Similarly, the finish mark can be applied onto the leading end portion of the document being discharged by determining the stamping timing on the basis of an output signal from the discharge sensor s4. At this time, it is possible to slow down the movement of the document being discharged and arbitrarily decide the position of the document, onto which the finish mark is applied, in the same manner as above. Furthermore, the to-and-fro motion of the stamp 68*b* can be appropriately controlled and selected in accordance with a system such as a copying machine to which the apparatus of this invention is applied.

Although the embodiment described above makes use of the inside roller set held by the shifting means by which the outside roller set is thrust upward to be separated from the feed roller set, as a countermeasure, the shifting means may be disposed on the outside roller set as described below.

Figure 9A:
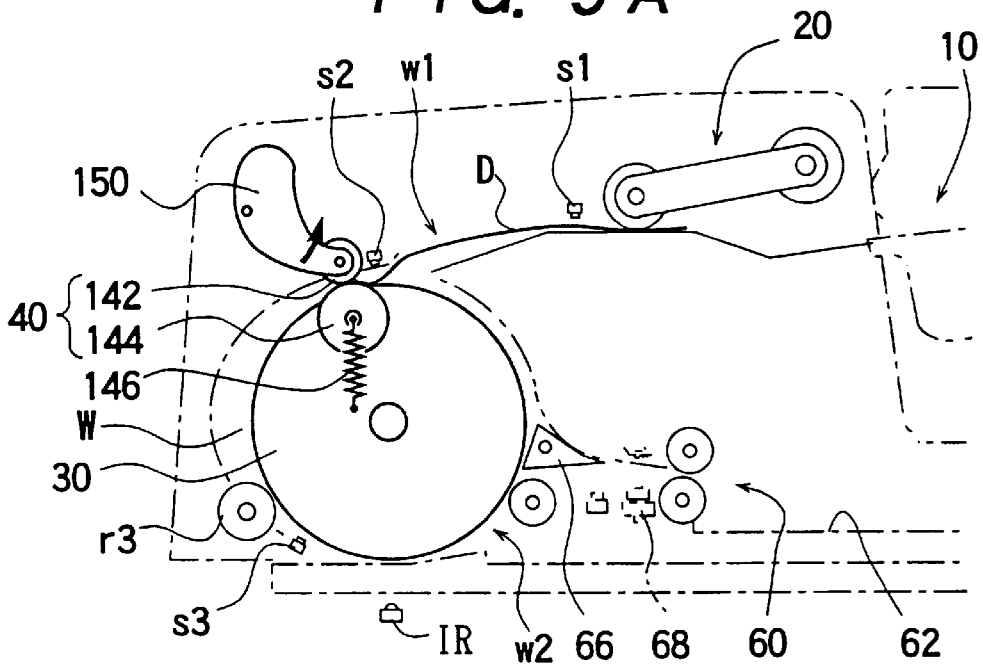
FIG. 9A and FIG. 9B are schematic views showing another embodiment of this invention.
Figure 9B:
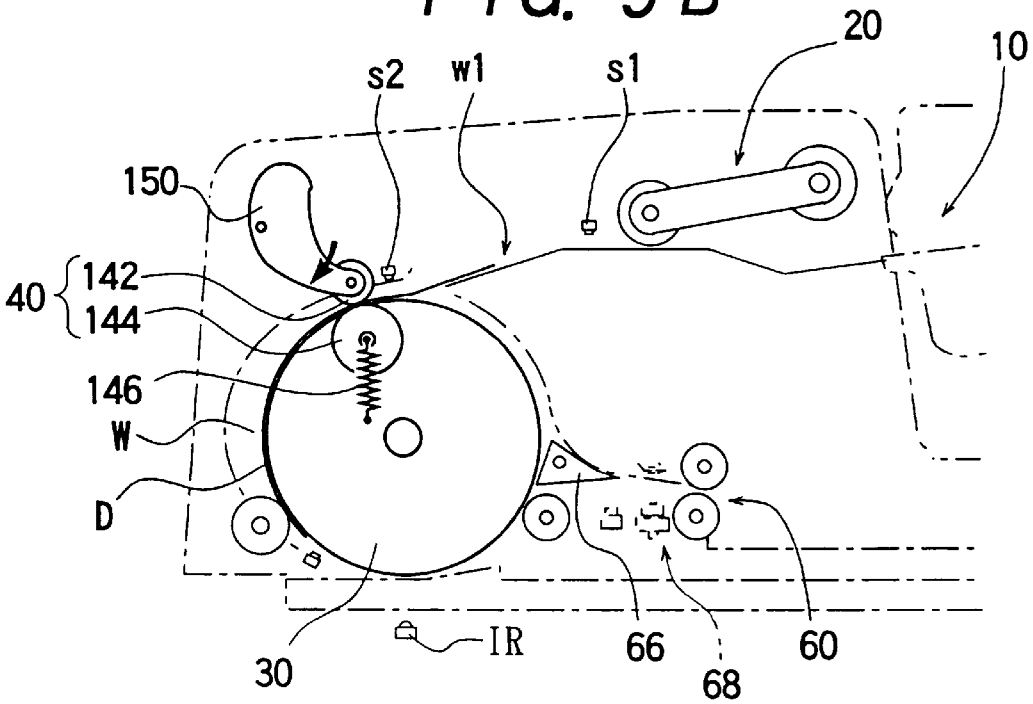

That is, as shown in FIG. 9A and FIG. 9B, an outside roller set 142 is held by a push member 152 of shifting means 150 so as to be movable to and fro relative to the feed roller set 30. An inside roller set 144 is in constant contact with the outside roller set 142 and energized by energizing means 146 so as to follow the outside roller set 142.

The outside roller set 142, inside roller set 144, energizing means 146 and shifting means 150 shown in FIG. 9A and FIG. 9B are identical with the outside roller set 42, inside roller set 44, energizing means 46 and shifting means 50 in the foregoing embodiment, respectively. The outside roller set 142 is formed of outside contacting roller elements movable so as to come into and out of contact with the feed roller set 30 similarly to the foregoing embodiment. The components depicted by like reference numerals with respect to those of the foregoing embodiment have analogous structures and functions to those of the foregoing embodiment. The description of these components is omitted below to avoid repetition.

In the state that the shifting means 150 takes its lower position as shown in FIG. 9A, the outside roller set (outside contacting roller elements) 142 is in contact with the feed roller set 30 and rotates in conjunction with the rotating feed roller set 30 to forward the document D along the feeding passage W. When the shifting means 150 takes its upper position as shown in FIG. 9B, the outside roller set 142 is separated from the feed roller set 30 by the upward energizing action of the inside roller set 144. Thus, the outside roller set 142 is not driven to be rested together with the inside roller set 144, thereby preventing the document D sent from the sheet supply unit 10 from being forwarded. Consequently, the sheet registering function is fulfilled similarly to the foregoing embodiment.

As is described above, the automatic sheet feeding apparatus according to this invention has the outside roller set and inside roller set which are operatively associated with the feed roller set in such a manner that the outside and inside roller sets movable to and fro relative to the the feed roller set are stopped when being out of contact with the feed roller set and rotated when being in contact with the feed roller set, thereby to prevent the document given from the sheet supply unit from being forwarded through the register means without stopping the feed roller set. Accordingly, the sheet registering function for correcting the orientation of the document being forwarded can be effectively fulfilled, and the document to be fed can be smoothly forwarded at high speed.

The register means formed of the outside roller set and inside roller set can be rationally incorporated in the sheet feeding apparatus, thus to prevent the increase in size and complexity of the sheet feeding system. Furthermore, the sheet feeding apparatus of this invention having an excellent sheet registering function can be applied serviceably to various image forming devices such as a copying machine, facsimile, and image scanner, and worked with great efficiency to automatically feed a plurality of sheets or documents to the image reading position of the image forming device.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic sheet feeding apparatus comprising a sheet supply unit having a sheet supply tray for stacking one or more sheets and a sheet delivery means for sending out said sheets one by one from said sheet supply unit, one or more sheet feed rollers having an outer periphery around which a sheet feeding passage is formed, a register means including one or more outside rollers movable into and out of contact with said feed rollers and one or more inside rollers movable into and out of contact with said outside rollers, and shifting means for rockingly moving one of said outside rollers and inside rollers to bring said outside rollers into and out of contact with said feed rollers.

2. An automatic sheet feeding apparatus as claimed in claim 1, wherein said inside rollers include one or more inside roller elements disposed adjacent to said feed rollers.

3. An automatic sheet feeding apparatus as claimed in claim 1, wherein said outside rollers include one or more contacting roller elements movable into and out of contact with said feed rollers and one or more operating roller elements movable into and out of contact with said inside rollers.

4. An automatic sheet feeding apparatus as claimed in claim 1, wherein said inside rollers include one or more inside roller elements disposed adjacent to said feed rollers, and said outside rollers are formed of one or more contacting roller elements movable into and out of contact with said feed rollers and one or more operating roller elements movable into and out of contact with said inside rollers.

5. An automatic sheet feeding apparatus as claimed in claim 1, wherein said outside rollers are energized toward said feed rollers by energizing means, and said shifting means is disposed on said inside rollers to bring said outside rollers into and out of contact with said feed rollers against said energizing means by said shifting means and said inside rollers.

6. An automatic sheet feeding apparatus as claimed in claim 1, wherein said inside rollers are energized toward said outside rollers by energizing means to bring said outside rollers into and out of contact with said feed rollers by said shifting means.

7. An automatic sheet feeding apparatus as claimed in claim 1, wherein said shifting means includes a push member supporting said inside rollers, said push member rockingly movable to bring said outside rollers into and out of contact with said feed rollers.

8. An automatic sheet feeding apparatus as claimed in claim 1, wherein said shifting means includes a push member supporting said outside rollers, said push member rockingly movable to bring said outside rollers into and out of contact with said feed rollers.

9. An automatic sheet feeding apparatus comprising a sheet supply unit having a sheet supply tray for stacking one or more sheets and a sheet delivery means for sending out said sheets one by one from said sheet supply unit, one or more sheet feed rollers having an outer periphery around which a sheet feeding passage is formed, a register means including one or more outside rollers movable into and out of contact with said feed rollers and one or more inside rollers movable into and out of contact with said outside rollers, shifting means for rockingly moving one of said outside rollers and inside rollers to bring said outside rollers into and out of contact with said feed rollers, a sheet discharge unit having a discharge passage for receiving the sheet from said sheet feeding passage, one or more discharge rollers disposed on said discharge passage, and a discharge tray for receiving the sheet sent out through said discharge passage, and a switch means disposed at an intersection point between said feeding passage and said discharge passage for selectively introducing the sheet sent from said feeding passage to said discharge passage or sending back the sheet sent into said discharge passage toward said feeding passage through a returning passage.

10. An automatic sheet feeding apparatus as claimed in claim 9, further comprising a discharge sensor disposed on said discharge passage and marking means for marking the sheet being sent out therethrough, said marking means being operated to apply a marking stamp onto said sheet based on detection of one end of said sheet by using said discharge sensor.

11. An automatic sheet feeding apparatus as claimed in claim 9, further comprising a discharge sensor disposed on said discharge passage, marking means for marking the sheet being sent out therethrough, and a control device for controlling movement of said discharge rollers in accordance with an output signal from said discharge sensor, said discharge rollers in rotation being slowed down when one end of said sheet being discharged is detected by said discharge sensor, and said marking means being operated to apply a marking stamp onto said sheet based on detection of one end of said sheet by using said discharge sensor.

12. An automatic sheet feeding apparatus as claimed in claim 9, wherein said outside rollers include of one or more contacting roller elements movable into and out of contact with said feed rollers and one or more operating roller elements movable into and out of contact with said inside rollers.

13. An automatic sheet feeding apparatus as claimed in claim 9, wherein said inside rollers include one or more inside roller elements disposed adjacent to said feed rollers, and said outside rollers include one or more contacting roller elements movable into and out of contact with said feed rollers and one or more operating roller elements movable into and out of contact with said inside rollers.

14. An automatic sheet feeding apparatus as claimed in claim 9, wherein said outside rollers are energized toward said feed rollers by energizing means, and said shifting means is disposed on said inside rollers to bring said outside rollers into and out of contact with said feed rollers against said energizing means by said shifting means and said inside rollers.

15. An automatic sheet feeding apparatus as claimed in claim 9, wherein said inside rollers are energized toward said outside rollers by energizing means to bring said outside rollers into and out of contact with said feed rollers by said shifting means.

16. An automatic sheet feeding apparatus comprising:

a sheet supply unit having a sheet supply tray for stacking one or more sheets and a sheet delivery means for sending out said sheets one by one from said sheet supply unit, one or more sheet feed rollers having an outer periphery around which a sheet feeding passage is formed, a register means including one or more outside rollers movable into and out of contact with said feed rollers and one or more inside rollers movable into and out of contact with said outside rollers, shifting means for rockingly moving one of said outside rollers and inside rollers to bring said outside rollers into and out of contact with said feed rollers, a sheet discharge unit having a discharge passage for receiving the sheet from said sheet feeding passage, one or more discharge rollers disposed on said discharge passage, and a discharge tray for receiving the sheet sent out through said discharge passage, a switch means disposed at an intersection point between said feeding passage and said discharge passage for selectively introducing the sheet sent from said feeding passage to said discharge passage or sending back the sheet sent into said discharge passage toward said feeding passage through a returning passage, a discharge sensor disposed on said discharge passage, and marking means for marking the sheet being sent out therethrough, said marking means being operated to apply a marking stamp onto said sheet based on detection of one end of said sheet by using said discharge sensor.

17. An automatic sheet feeding apparatus as claimed in claim 16, wherein said inside rollers include one or more inside roller elements disposed adjacent to said feed rollers.

18. An automatic sheet feeding apparatus as claimed in claim 16, wherein said outside rollers include one or more contacting roller elements movable into and out of contact with said feed rollers and one or more operating roller elements movable into and out of contact with said inside rollers.

19. An automatic sheet feeding apparatus as claimed in claim 16, wherein said inside rollers include one or more inside roller elements disposed adjacent to said feed rollers, and said outside rollers include one or more contacting roller elements movable into and out of contact with said feed rollers and one or more operating roller elements movable into and out of contact with said inside rollers.

20. An automatic sheet feeding apparatus as claimed in claim 16, wherein said outside rollers are energized toward said feed rollers by energizing means, and said shifting means is disposed on said inside rollers to bring said outside rollers into and out of contact with said feed rollers against said energizing means by said shifting means and said inside rollers.

21. An automatic sheet feeding apparatus as claimed in claim 16, wherein said inside rollers arc energized toward said outside rollers by energizing means to bring said outside rollers into and out of contact with said feed rollers by said shifting means.

22. An automatic sheet feeding apparatus as claimed in claim 16, wherein said shifting means includes a push member supporting said inside rollers, said push member being rockingly movable to bring said outside rollers into and out of contact with said feed rollers.

23. An automatic sheet feeding apparatus as claimed in claim 16, wherein said shifting means includes a push member supporting said outside rollers, said push member being rockingly movable to bring said outside rollers into and out of contact with said feed rollers.

* * * * *

UNITED STATES PATENT AND TRADEMARK OFFICE

CERTIFICATE OF CORRECTION

PATENT NO. : 5,921,545

DATED : July 13, 1999

INVENTOR(S) : Kobayashi, et al.

It is certified that error appears in the above-identified patent and that said Letters Patent is hereby corrected as shown below:

On the title page, after Item [22], please insert the following;

[30] Foreign Application Priority Data

March 14, 1997 [JP] Japan.....9-081832

April 15, 1997 [JP] Japan.....9-114363

Signed and Sealed this

Fourteenth Day of December, 1999

*Attest:*

*Attesting Officer*

Q. TODD DICKINSON

*Acting Commissioner of Patents and Trademarks*